US005217125A

United States Patent [19]

Swanson

[11] Patent Number: 5,217,125

[45] Date of Patent: Jun. 8, 1993

[54] COLLAPSIBLE RACK FOR USE IN TRANSPORT CAR STORAGE

[75] Inventor: David G. Swanson, Ballwin, Mo.

[73] Assignee: Tier Rack Corporation, Ballwin, Mo.

[21] Appl. No.: 712,787

[22] Filed: Jun. 10, 1991

[51] Int. Cl.[5] ..... A47F 5/00

[52] U.S. Cl. ..... 211/195; 108/132

[58] Field of Search ..... 211/195, 149; 108/56.1, 108/51.1, 125, 127, 129, 132

[56] References Cited

U.S. PATENT DOCUMENTS

| | | | |
|---|---|---|---|
| 711,562 | 10/1902 | Garben | 108/132 |
| 1,700,843 | 2/1929 | Hayward | 211/195 X |
| 2,498,414 | 2/1950 | Gondar | 220/8 |
| 2,541,722 | 2/1951 | Shackelford | 211/195 |
| 2,739,776 | 3/1956 | Terando | 248/120 |
| 2,909,349 | 10/1959 | Morris | 248/120 |
| 3,499,398 | 3/1970 | Murray | 108/53 |
| 3,565,018 | 2/1971 | Jay | 108/53 |
| 3,945,501 | 3/1976 | Jay | 211/177 |
| 3,998,169 | 12/1976 | Koch | 108/53.5 |
| 4,191,112 | 3/1980 | Maldonado | 108/53.3 |
| 4,199,069 | 4/1980 | Talarico | 211/194 |
| 4,266,678 | 5/1981 | Daly | 211/194 |
| 4,353,520 | 10/1982 | Jansson | 248/346 |
| 4,703,702 | 11/1987 | Speicher | 108/56.3 |
| 4,715,296 | 12/1987 | Wilkinson | 108/132 X |
| 4,993,726 | 2/1991 | Schumacher et al. | 108/129 X |

*Primary Examiner*—Robert W. Gibson, Jr.

*Attorney, Agent, or Firm*—Armstrong, Teasdale, Schlafly & Davis

[57] ABSTRACT

A collapsible rack is disclosed for use in the storage area of a tractor trailer or a freight car of a train to facilitate storage of transported goods. The collapsible rack generally comprises an upper section having top and bottom surfaces and a plurality of legs connected to the upper section. Structure is provided for rotatably mounting the legs in association with the upper section to allow the legs to pivot between an extended position for supporting the upper section and a retracted position in which the legs can overlie, and be parallel to, the upper section. A stabilizing means is connected to the upper section for maintaining the legs in the extended position. The stabilizing means also can act to elevate a retracted rack above a storage floor to permit access of lift elements such as of a fork lift, beneath a stored rack for lifting.

28 Claims, 2 Drawing Sheets

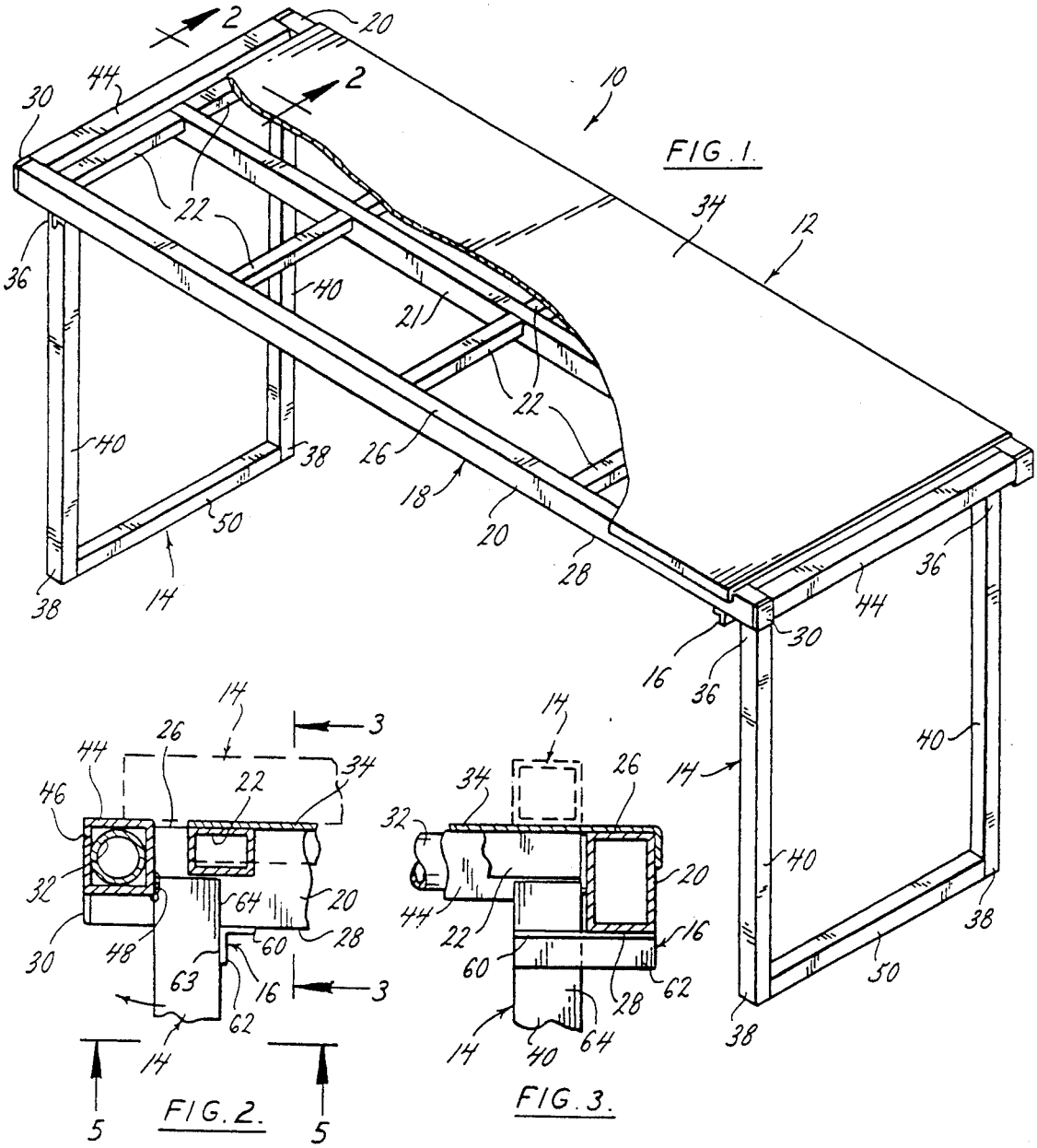
FIG. 1.
FIG. 2.
FIG. 3.
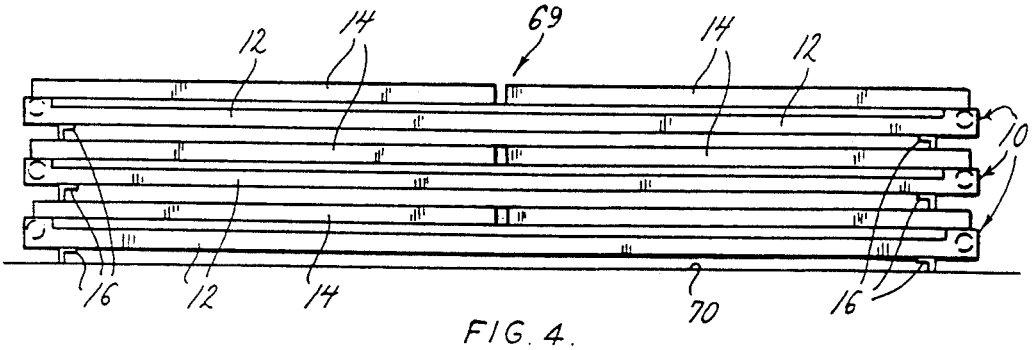
FIG. 4.

FIG. 5.
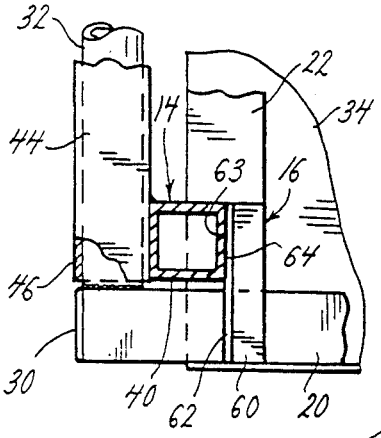
FIG. 6.
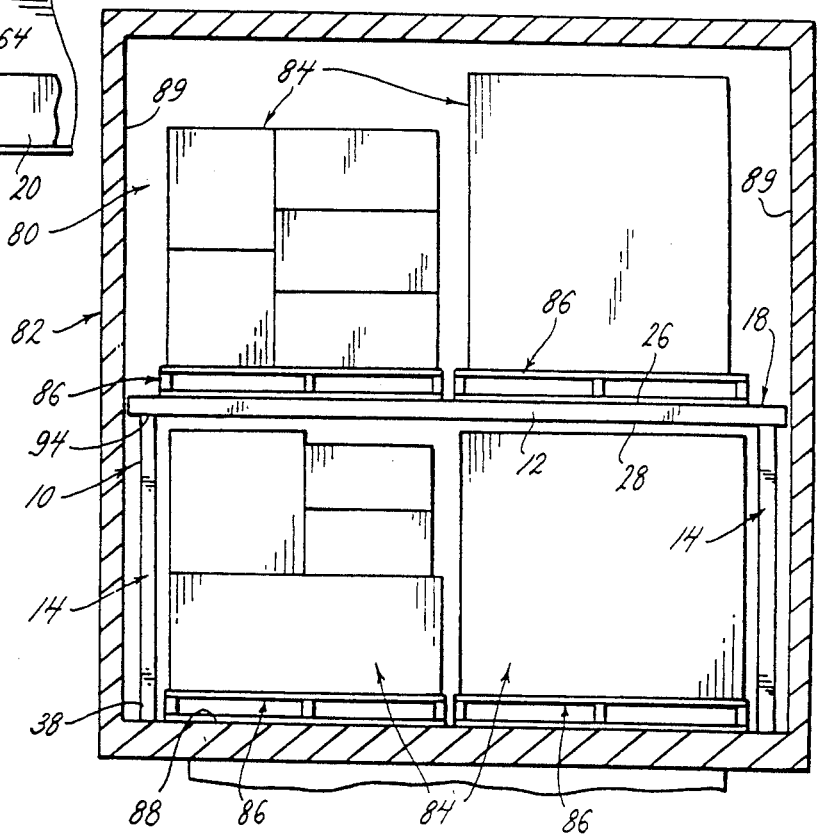
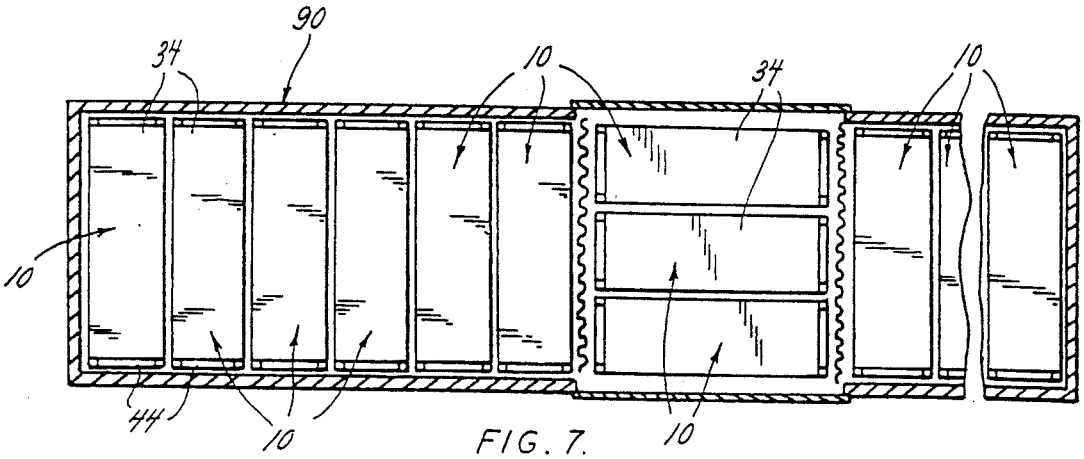
FIG. 7.

COLLAPSIBLE RACK FOR USE IN TRANSPORT CAR STORAGE

BACKGROUND OF THE INVENTION

This invention relates to racks for use in the storage area of a truck or a freight car of a train, to facilitate storage of transported goods. More particularly, the invention relates to a collapsible rack for such use, having rotatably mounted legs which pivot between an operative extended position and a retracted position for compactly storing the rack Trucks, such as tractor trailers, and trains transport large quantities of goods. The goods are typically stacked from the floor to the ceiling in the storage area of the trucks or the freight cars of the train. The goods located at the bottom of the stack are usually subjected to substantial weight from goods stacked higher in the stack. The force of the weight may damage the goods located at the bottom of the stack. This is particularly true for delicate goods which cannot withstand heavy loads.

To overcome this problem, racks have been developed to reduce the load created from stacking goods from the floor to the ceiling of the storage area. These prior art racks typically have a bottom support surface and four legs extending upwardly from the support surface. See for example Daly, U.S. Pat. No. 4,266,678 and Talarico, U.S. Pat. No. 4,199,069. The racks disclosed in these references are nestable, and therefore require at least two racks to be stacked contiguously to provide an upper support surface to reduce the size of the stack by half.

When the goods have been transported to their destination, it is desirable to collapse the racks to a retracted position for compact storage. Past attempts have been directed to collapsible racks. See for example Murray, U.S. Pat. No. 3,499,398 and Gondar, U.S. Pat. No. 2,498,414. However, these prior art collapsible racks incorporate complicated collapsing mechanisms or the use of pins and the like which are subject to fatigue and break down.

It is further desirable to have a rack that can be stacked for storage with like racks so as to be easily accessible for lifting and transporting to other locations. It is desirable to elevate the rack for access to lift machines such as fork lifts.

The collapsible rack of this invention overcomes the problems associated with the previously developed racks.

SUMMARY OF THE INVENTION

The collapsible rack of the present invention provides a sturdy rack for transporting goods in the storage area of a tractor trailer or the freight oar of a train. Importantly, the rack is constructed with a minimal number of moving parts which minimizes breakdown and increases the longevity of the rack. The rack comprises an upper section having top and bottom surfaces. Legs are rotatably mounted to the upper section to allow the legs to pivot between an extended position for supporting the upper section and a retracted position. Stabilizing apparatus is also provided for maintaining the legs in the extended position.

In the preferred embodiment, the stabilizing apparatus comprises brace members connected to the upper section. The brace members are positioned so that the legs contact the brace members when the legs are in the extended position. Preferably, the brace members are connected to the bottom surface of the upper section adjacent to the rotatable connection of the legs to the upper section so that a side of each leg contacts a corresponding brace member.

Structure is provided to rotatably mount each of the legs to the upper section. In the preferred embodiment, the legs rotate about 270 degrees from the extended position to the retracted position, in which position, the legs extend approximately parallel to the upper section and lie above the upper section. The upper section has a pair of side ends, and a rod corresponding to each of the side ends. The rod extends generally parallel to the corresponding side end. The legs have proximal and distal ends. Each leg has a sleeve connected near the proximal end of the leg. The sleeve is sized to rotatably receive the rod so that the legs can rotate about the rod. In the preferred embodiment, a pair of legs are located at each side end. The sleeve extends between the pair of legs to connect those legs.

Structure is also provided for elevating the rack when the rack is in the retracted position to allow the blades of a fork truck to be received under the retracted rack. In the preferred embodiment, the brace members elevate the rack.

The top surface of the upper section of the rack is a flat continuous surface in the preferred embodiment. When the legs are in the extended position, transported goods can be placed below and on top of the top surface of the upper section.

In an alternative embodiment, the legs of the rack are mounted to the rack in the extended position. The legs are not able to rotate.

BRIEF DESCRIPTION OF THE DRAWINGS

FIG. 1 is an isometric view of the collapsible rack constructed according to the principles of this invention, showing the legs in the extended position.

FIG. 2 is a longitudinal cross-sectional view taken along the plane of line 2—2 of FIG. 1, showing the connection of a leg to a sleeve.

FIG. 3 is a transverse cross-sectional view taken along the plane of line 3—3 of FIG. 2.

FIG. 4 is a side elevation view of a stack of racks in the retracted position.

FIG. 5 is a bottom cross-sectional view taken along the plane of line 5—5 of FIG. 2.

FIG. 6 is an elevation view of a storage area of a tractor trailer containing the rack of the present invention.

FIG. 7 is a top plan view of a freight car of a train showing the placement of a plurality of the racks therein.

DETAILED DESCRIPTION OF THE PREFERRED EMBODIMENT

The collapsible rack constructed according to the principles of the present invention shown in FIG. 1 is referred to generally as 10. The rack 10 generally comprises an upper section 12, rotatable legs 14, and brace members 16.

The upper section 12 has a frame 18. The frame 18 comprises outer longitudinal beams 20, a center longitudinal beam 21, and transverse beams 22. The beams 20, 21 and 22 are interconnected by means well known in the art such as welding. The beams 20, 21 and 22 are of rectangular cross-section. Cross-sections of beams 20 and 22 are shown in FIGS. 3 and 2, respectively. The frame 18 has a top surface 26 and a bottom surface 28. The frame 18 has a pair of transverse side ends 30. The frame further comprises a rod 32 (shown in FIG. 2) corresponding to each side end 30. The ends of each rod 32 are secured by known means to the beams 20 adjacent the corresponding side end 30. The rods 32 thus extend adjacent to and generally parallel to the corresponding side end 30.

A flat continuous sheet 34 of durable material, such as sheet metal, can be secured by known means such as spot welding to the upper section top surface 26. Goods can be placed on sheet 34 above the top of the upper section 12. The thickness of the sheet 34 can vary depending on the load requirements of the transported goods.

The four legs 14 are rotatably connected to the upper section 12 between an extended position (shown in FIG. 1) and a retracted position (shown in FIG. 4, and in FIGS. 2 and 3 by the shadow lines). The legs 14 have proximal ends 36 and distal ends 38. The legs 14 are arranged in two pair of legs 40, one pair of legs 40 corresponds to each of the side ends 30. A rotatable sleeve 44 extends parallel to the side end 30 and interconnects each pair of legs. Referring to FIG. 2, the cross-section 46 of the sleeve 44 is generally square and is sized to receive the rod 32 to allow the sleeve 44 to pivot about the rod 32. The legs 14 are connected to the sleeve 44 at junction 48 (shown in FIG. 2) by means known in the art, such as welding. Each pair of legs 40 moves integrally with its corresponding sleeve 44. The pair of legs 40 can thus be rotated about the rod 32. To move the pair of legs 40 to the retracted position, the legs should be rotated in the direction indicated by the arrow in FIG. 2. The pair of legs 40 can thus be rotated from the extended position towards the side ends 30 to the retracted position in which each leg 14 of the pair 40 extends generally parallel to and lies above the top surface 26 of the upper section 12.

The legs 14 of each pair 40 are also connected by a cross brace 50 near the distal leg ends 36. The cross brace 50 provides lateral stability for the rack 10.

It is understood that the sleeve cross-section 46 could be configured differently, such as in a circular configuration sized slightly larger than the diameter of the rod 32 to rotatably receive the rod. It should also be understood that each leg 14 could be connected to a corresponding sleeve sized to receive and rotate about the rod 32, without the legs 14 being joined by cross brace 50. In such an embodiment, the legs would rotate individually about the rod 32. A rack 10 constructed according to this suggested alternative embodiment would provide less stability than the rack described in the preferred embodiment.

The rack 10 also comprises brace members 16 which stabilize the legs 14 and maintain the legs 14 in the extended position when the distal leg ends 38 are placed on a supporting surface, such as the floor of a freight car of a train. As best shown in FIG. 2, the brace members 16 are connected to the bottom surface 28 of the outer longitudinal beams 20 of the upper section 12. The brace members 16 are illustrated as angle irons, each with its first horizontal side wall 60 and second vertical side wall 62. The first wall 60 has its upper surface facing the bottom surface 28, and the leg 60 is connected to surface 28 by means known in the art, such as welding. The second wall 62 extends generally perpendicularly downwardly from the bottom surface 28 of the upper section 12. The second wall 62 has an outwardly facing surface 63 that contacts the leg 14 in the extended position to prevent further rotation of the pair of legs 40 when the pair of legs are rotated from the retracted position to the extended position. The first wall 60 should therefore be connected to the bottom surface 28 so that the second wall 62 prevents further rotational movement of the pair of legs 40 when the legs extend perpendicularly away from the bottom surface 28, as shown in FIG. 3. Sides 64 of the legs 14 will therefore contact the outer surface 63 of the brace wall 62 when the pair of legs 40 are rotated to the extended position.

In the preferred embodiment shown, there is a brace member 16 for each leg 14, which is connected to the bottom surface 28 adjacent the connection of each leg 14 to the upper section 12 as described above. The braces 16 prevent the pair of legs 40 from rotating further inwardly from the extended position. When the legs 14 are contacting a supporting surface, such as the floor of the storage area, each pair of legs 40 is also prevented from moving outwardly towards the retracted position under normal forces experienced during the transport of goods, such as centrifugal forces or sliding movement. This is so because the braces 16 corresponding to one of the pair of legs 40 prevents further inwardly movement of that pair, which prevents the other pair of legs 40 from moving outwardly towards the retracted position under normal transport forces. It is understood that with the legs 14 of each pair of legs 40 interconnected as shown, only one brace member 16 need be used to maintain the pair of legs 40 in the extended position. Thus, one brace member must be connected at each of the side ends 30 to contact a leg 14, as described above. Nevertheless, matching one brace member 16 to each leg 14 provides greater stability.

The brace members 16 could be of a different configuration, such as a rectangular block. Desirable configurations should have one flat side which facilitates connection of the brace member to the bottom surface 28 of the upper section 12, and another side for abutting the side 64 of the legs 14 when the pair of legs 40 are in the extended position. As noted, the preferred embodiment uses an angle iron.

With reference to the stack 69 of racks 10 shown in FIG. 4, the rack 10 also includes structure for elevating the lower rack 10 above a supporting surface 70, such as the floors of a storage area, as shown in FIG. 4. The racks 10 should be elevated sufficiently to allow the fork blades of a fork truck, known in the art, to be received under the upper section 12 of the lower rack 10 in the stack 69 so that the stack 69 can be lifted and moved when the racks 10 are stored in the retracted position. In the preferred embodiment, the second side wall 62 of the braces 16 elevates the rack 10 off of the supporting surface 70 when the racks 10 are in the retracted position.

OPERATION

In operation, and for illustration, the rack 10 is in the retracted position. To use a rack 10, the pair of legs 40 are rotated to the extended position shown in FIG. 1. For example, with reference to the pair of legs 40 that are on the right side of a rack 10 shown in FIG. 1, after the rack 10 is removed from the stack 69, the pair of legs is rotated clockwise about 270° until the legs 14 of pair 40 contact the brace side wall 62 to be blocked from further rotation. The rack 10 can then be placed in the storage area 80 of a truck 82 across the width of the storage area as shown in FIG. 6. Transported goods 84 stacked on crates 86 can then be placed on top of the flat sheet 34 of the upper section 12 and can also be placed below the upper section 12 on the floor 88 of the storage area 80. The distal leg ends 38 likewise rest on the floor 88. When the rack 10 is in the extended position and is resting on the floor 88, the brace side walls 62 prevent the pairs of legs 40 from moving inwardly and outwardly as explained above. Further, the sides 89 of the truck act to prevent all but a limited degree of rotation of the legs 14 to the retracted position. FIG. 7 shows the racks 10 placed side by side in a freight car 90 of a train.

Alternatively, if the pivoting leg feature is not desired, the legs 14 could be rigidly mounted to the upper section 12 of the rack 10. The legs therefore could not rotate between the extended and retracted positions. The legs 14 could be welded to bottom surface 94 of the transverse beams 22 located nearest the side ends 30.

DIMENSIONS

In the preferred embodiment illustrated, the following dimensions can be used. The distance between the outer edges of the longitudinal beams 20 of the upper section 12 is approximately 38 inches (96 cm). The distance between the side ends 30 of the upper section 12 is approximately 106 inches (269 cm). The length of each leg 14 is approximately 50 inches (127 cm). When the legs 14 are in the extended position, the distance between opposing sides 64 of the legs 14 is approximately 98 inches (248 cm). These dimensions could of course be varied to serve the particular size requirements of the transporting vehicle or the transported goods.

The foregoing specific embodiments have also been described for the purpose of illustrating the principles of the present invention, and the same is subject to modification without departure therefrom. Therefore, the invention includes all modifications encompassed within the spirit and scope of the appended claims.

I claim:

1. A collapsible rack for use in the storage area of a tractor trailer or a freight car of a train to facilitate storage of transported goods, the rack comprising:

an upper section having top and bottom surfaces;

a plurality of legs;

means for rotatably mounting the legs in association with the upper section to allow the legs to pivot between an extended position for supporting the upper section and a retracted position in which the legs extend approximately parallel to the upper section and lie above the upper section;

and stabilizing means for maintaining the legs in the extended position, the stabilizing means being associated with the upper section.

2. The collapsible rack of claim 1 wherein the upper section comprises a pair of side ends, and the distance from the upper section side end to the stabilizing means is greater than the distance from the side end to the rotatable connection of the legs to the upper section.

3. The collapsible rack of claim 1 wherein the stabilizing means comprises at least one brace member associated with the upper section, the brace member being located so that at least one of the legs contacts the brace member to stabilize the leg when the leg is in the extended position.

4. The collapsible rack of claim 3 wherein the brace member is connected to the upper section adjacent the rotatable mounting of at least one of the legs to the upper section so that said leg contacts the brace member when the leg is in the extended position.

5. The collapsible rack of claim 4 wherein the brace member is connected to the bottom surface of the upper section, and wherein said leg has a side and the side of said leg contacts the brace in the extended position.

6. The collapsible rack of claim 2 wherein each of the legs is mounted for rotation of about 270 degrees from the extended position to the retracted position.

7. The collapsible rack of claim 1 wherein the upper section comprises a pair of side ends and at least one rod corresponding to one of the side ends, the rod extending generally parallel to the corresponding side end.

8. The collapsible rack of claim 7 wherein each leg has a proximal end and a distal end, the proximal leg ends being located adjacent the connection of the legs to the upper section, and wherein the rotatable mounting means comprises a sleeve connected to the legs near the proximal ends, the sleeve being sized to rotatably receive the rod so that the sleeve and legs can rotate about the rod.

9. The collapsible rack of claim 8 wherein the rotatable mounting means comprises a pair of legs associated with one of the side ends, the sleeve extending between the said pair of legs to connect the said legs.

10. The collapsible rack of claim 5 wherein the brace member comprises an angle iron having first and second sides, the first side of the angle iron being connected to the bottom surface of the upper section and the second side extending generally perpendicularly away from the bottom surface of the upper section so that a side of the leg contacts the second side of the brace member when the leg is in the extended position.

11. The collapsible rack of claim 5 wherein each of the brace members comprise a generally rectangular block member.

12. The collapsible rack of claim 1 further comprising means for elevating the collapsible rack when the legs are in the retracted position so that blades of a fork truck can be received under the bottom surface of the upper section.

13. The collapsible rack of claim 12 wherein the elevating means is the same as the stabilizing means.

14. The collapsible rack of claim 1 wherein the top surface of the upper section is a flat continuous surface so that the transported goods can be placed on top of the top surface.

15. A rack for use in the storage area of a tractor trailer or a freight car of a train, the rack comprising:

an upper section having a flat continuous top surface and a bottom surface and a pair of side ends;

a plurality of legs rotatably connected to the upper section;

and means for stabilizing the legs in the extended position, the distance from the side ends to the stabilizing means being greater than the distance from the side ends to the rotatable connection of the legs to the upper section.

16. The rack of claim 15 wherein the stabilizing means comprises at least two brace members associated with the bottom surface of the upper section, the brace members being located so that the leg contacts the brace member to stabilize the leg.

17. The rack of claim 16 wherein the brace member is connected to the upper section adjacent the connection of the legs to the upper section so that said legs contact the brace member when the legs are in the extended position.

18. The rack of claim 17 where each of the legs is mounted for rotation of about 270° from the extended position to the retracted position and wherein in the retracted position the legs extend approximately parallel to the upper section and lie above the upper section.

19. A collapsible rack for use in the storage area of a tractor trailer or a freight car of a train, to facilitate storage of transported goods, the rack comprising:

an upper section having a flat continuous top surface and bottom surfaces, and also having a pair of side ends and a rod corresponding to each of the side ends, the rod extending generally parallel to the corresponding side end;

one pair of legs corresponding to each of the side ends, each of the legs having proximal and distal ends, the proximal ends being located adjacent the connection of the legs to the upper section, each pair of legs having a cross member connected between the legs near the proximal ends, each cross member being sized to rotatably receive the rod of the upper section to allow the sleeve and legs to pivot about 270° from an extended position for supporting the upper section to a retracted position and which in the retracted position the legs extend approximately parallel to the upper section and lie above the upper section; and at least one brace member associated with each pair of legs to maintain the legs in the extended position, the brace members being associated with the upper section, and the brace members being located so that at least one leg of each pair of legs contacts the brace member when the legs are in the extended position to stabilize the legs.

20. The collapsible rack of claim 19 wherein the brace members are connected to the upper section adjacent the rotatable mounting of each pair of legs to the upper section.

21. The collapsible rack of claim 20 wherein the brace member is connected to the bottom surface of the upper section, and wherein the legs have a side and the side of at least one leg of each pair of legs contacts the brace in the extended position.

22. The collapsible rack of claim 21 wherein the upper section comprises a pair of side ends, and the distance from the upper section side end to the brace member is greater than the distance from the side end to the rotatable connection of the legs to the upper section.

23. The collapsible rack of claim 22 wherein each pair of the legs is mounted for rotation of about 270° degrees from the extended position to the retracted position and which in the retracted position the legs extend approximately parallel to the upper section and lie above the upper section.

24. A collapsible rack for use in the storage area of a tractor trailer or a freight car of a train to facilitate storage of transported goods, the rack comprising:

an upper section having a top surface, a bottom surface, a pair of side ends, and a rod attached to each of the side ends;

each leg having a proximal end and a distal end, the proximal leg ends being located adjacent the connection of the legs to the upper section; means for rotatably mounting the legs in association with the upper section to allow the legs to pivot between an extended position for supporting the upper section and a retracted position, the rotatable mounting means comprising a sleeve connected to the leg near the proximal end of each leg, the sleeve being sized to rotatably receive the rod so that the sleeve and legs can rotate about the rod such that the legs are pivotable between an extended position for supporting the upper section and a retracted position; and stabilizing means for maintaining the legs in the extended position, the stabilizing means being associated with the upper section.

25. The collapsible rack of claim 24 wherein a pair of legs is associated with each side end, and a sleeve interconnects each pair of legs such that each pair of legs is rotatably connected to each side end.

26. The collapsible rack of claim 25 wherein each pair of legs is mounted for rotation about 270° from the extended position to the retracted position and wherein in the retracted position each pair of legs extends approximately parallel to the upper section and lies above the upper section.

27. A collapsible rack for use in the storage area of a tractor trailer or a freight car of a train to facilitate storage of transported goods, the rack comprising:

an upper section having top and bottom surfaces;

a plurality of legs;

means for rotatably mounting the legs in association with the upper section to allow the legs to pivot between an extended position for supporting the upper section and a retracted position;

stabilizing means for maintaining the legs in the extended position, the stabilizing means being associated with the upper section; and means for elevating the collapsible rack when the legs are in the retracted position so that blades of a fork truck can be received under the bottom surface of the upper section.

28. The collapsible rack of claim 27 wherein the elevating means is the same as the stabilizing means.

* * * * *